United States Patent [19]

Horiguchi

[11] Patent Number: 4,504,961

[45] Date of Patent: Mar. 12, 1985

[54] PLURAL-SHEET DETECTOR

[75] Inventor: Satoru Horiguchi, Saitama, Japan

[73] Assignee: Dai Nippon Insatsu K.K., Tokyo, Japan

[21] Appl. No.: 565,121

[22] Filed: Dec. 22, 1983

Related U.S. Application Data

[63] Continuation of Ser. No. 254,463, Apr. 15, 1981, abandoned.

[30] Foreign Application Priority Data

Apr. 19, 1980 [JP] Japan ..... 55-51105

[51] Int. Cl.[3] ..... G06M 7/06

[52] U.S. Cl. ..... 377/8; 271/263

[58] Field of Search ..... 377/8, 39; 271/262, 271/263; 355/14 CU; 340/674

[56] References Cited

U.S. PATENT DOCUMENTS 3,778,051 12/1973 Allen et al. ..... 271/263
3,930,582 1/1976 Gartner et al. ..... 235/92 SB
4,072,854 2/1978 Oshima et al. ..... 235/92 SB
4,121,716 10/1978 Luperti et al. ..... 271/263
4,154,437 5/1979 Butcheck et al. ..... 271/263
4,339,657 7/1982 Larson et al. ..... 235/92 SB

OTHER PUBLICATIONS

"Double Document Detect System" by Boothroyd, Published in IBM Technical Disclosure Bulletin, vol. 19, No. 12, May 1977, pp. 4749–4750.

*Primary Examiner*—Stanley D. Miller
*Assistant Examiner*—K. Ohralik
*Attorney, Agent, or Firm*—Koda and Androlia

[57] ABSTRACT

In a plural-sheet detector for a printing machine, which detects the number of sheets piled as the number of serial pulse signals, in which whenever the serial pulse signals are detected, the count value is provided, the count value being compared with a reference count value to provide a deviation value representative of the difference therebetween, and the deviation value is compared with a reference deviation value, so that when the deviation value is larger than the reference deviation value, the number of sheets is determined unacceptable.

2 Claims, 7 Drawing Figures

PLURAL-SHEET DETECTOR

This is a continuation of application Ser. No. 254,463, filed Apr. 15, 1981, now abandoned.

BACKGROUND OF THE INVENTION

This invention relates to a device for detecting the unacceptable number of sheet-shaped materials piled one on another, for instance as in the double sheet detection in a sheet-fed press.

In general, an off-set press or the like employs a sheet-fed printing system in which sheets equal in size are fed to the printing machine one after another. Therefore, the printing machine often suffers from a so-called "double sheet" trouble that two sheets or more piled one on another are delivered to the printing machine at the same time.

If the double sheet trouble occurs, then blank sheets are mixed in the printed sheets. This will not only cause another trouble in the following process such as for instance bookbinding, but also damage the printing machine at worst. Accordingly, it is necessary to positively detect the presence of double sheets, thereby to prevent the delivery of two sheets or more piled to the printing machine.

Heretofore, a double sheet detecting method is usually employed, in which when a sheet supplied from a sheet supplying device is stopped by a stopper immediately before it goes into the printing process, the thickness of the sheet is measured, so that it is determined from the measured thickness whether or not the double sheet trouble occurs. In order to measure the sheet thickness, a mechanical method, as optical method or an electrical method has been employed.

In the typical example of the mechanical method, the sheet is depressed by a suitable contactor, so that the sheet thickness is measured from the displacement of the contactor. Accordingly, the mechanical method is disadvantageous in that it is difficult to measure the thickness of a sheet with high accuracy since a sheet is in general considerably thin, and accordingly the result of the measurement is not reliable. Furthermore, the surface of a sheet is liable to be damaged by the depression of the contactor, and whenever the kind of sheet is changed, a delicate adjustment is required.

In the optical method, light is applied to one side of a sheet, and the quantity of light passed through the sheet is measured to determine the thickness of the sheet. Accordingly, the optical method is advantageous in that no mechanical contact with the sheet is required, and therefore no damage is given to the sheet at all, and a thin sheet can be measured with high accuracy. However, the optical method is still disadvantageous in the following points: The measurement is liable to be erroneous for sheets such as hungry sheets which are not uniform in transmissivity. Furthermore, the optical method is not applicable to heavy sheets low in transmissivity and it is not suitable for the measurement of the thickness of a colored sheet other than a white sheet, because the thickness cannot be detected with sufficiently high accuracy. Especially in the case where both sides of a sheet are printed, in the second printing operation the portions of the sheet where patterns have been printed in the first printing operation cannot be used for the detection. Therefore, the detection is difficult, or impossible at worst.

In the typical example of the electrical method, the thickness of a sheet is detected from the variation of an electrostatic capacitance of a sheet to be measured which operates as the dielectric. The electrical method is advantageous in that, similarly as in the optical method, it is unnecessary to contact the sheet to be measured with a detecting element, and the measurement can be achieved irrespective of the transmissivity of the sheet; i.e. almost all the difficulties accompanying the optical method are eliminated. However, the electrical method still suffers from the problems that the measurement is liable to be affected by the drift of the electrical circuit and the variation in dielectric characteristic of a sheet due to the variations of the ambient temperature and humidity, and furthermore the measurement is affected by external electrical noise, as a result of which the accuracy of detection is not sufficient.

SUMMARY OF THE INVENTION

Accordingly, an object of this invention is to eliminate the above-described difficulties accompanying a conventional plural-sheet detecting method.

Another object of the invention is to provide a plural-sheet detector in which the measurement is not affected by the drift of an electrical circuit and the variation in dielectric characteristic of a sheet to be measured due to the ambient temperature or humidity.

A further object of the invention is to provide a plural-sheet detector in which the detection can be carried out with sufficiently high accuracy by an electrical thickness measuring method or by an optical thickness measuring method.

The foregoing objects and other objects of the invention have been achieved by the provision of a plural-sheet detector for detecting a number of sheet-shaped materials piled one on another as a number of serial pulse signals, which, according to the invention, comprises: means for providing, whenever the serial pulse signals are detected, a count value thereof; means for providing a deviation value representative of the difference between the count value and a reference count value; and decision means for comparing the deviation value with a reference deviation value, so that when the deviation value exceeds the reference deviation value, the number of sheet-shaped materials is determined unacceptable.

The nature, principle and utility of the invention will become more apparent from the following detailed description when read in conjunction with the accompanying drawings.

DETAILED DESCRIPTION OF THE INVENTION

Figure 1:
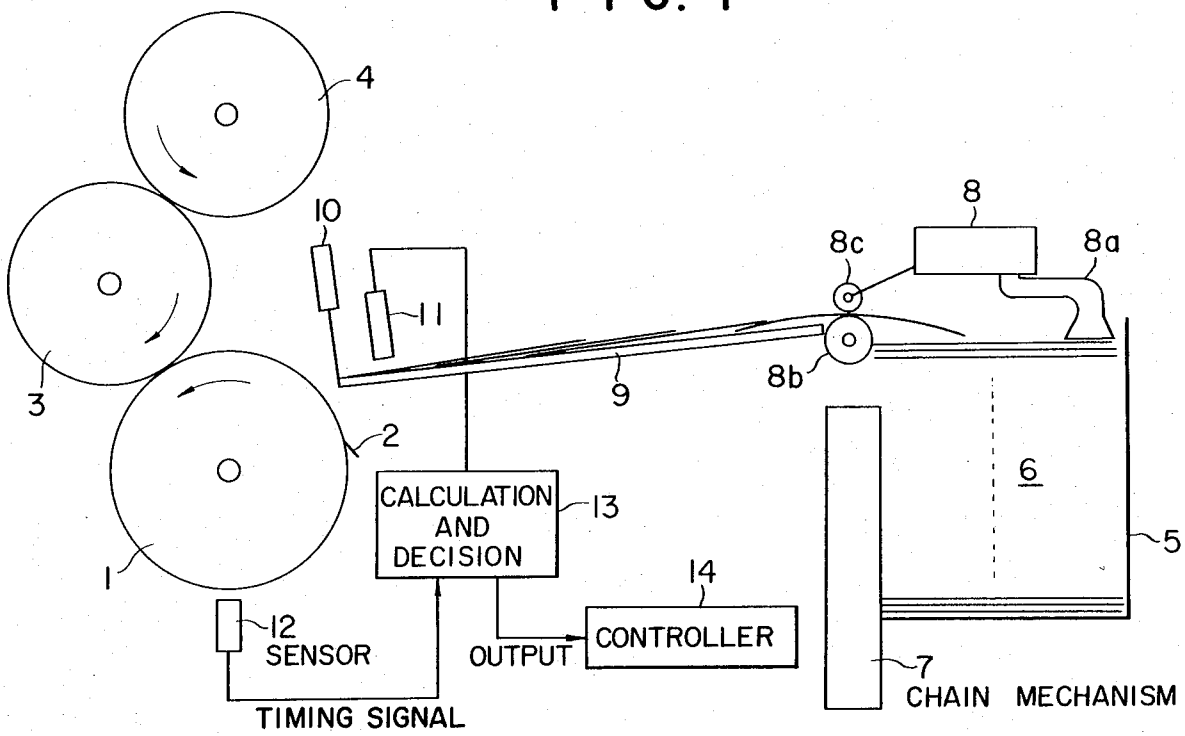
FIG. 1 is a schematic diagram showing one example of a printing machine with a double sheet detector.

FIG. 1 is a schematic diagram showing an offset press in which a plural-sheet detecting device according to this invention is employed as a double-sheet detector.

The offset press, as shown in FIG. 1, comprises a compression cylinder 1, a gripper 2, a blanket cylinder 3, a plate cylinder 4, a printing sheet hopper 5, in which printing sheets 6 are contained, a chain mechanism 7, a sheet supplying device 8, a sheet pick-up unit 8*a* for feeding a sheet by sucking and retaining it, a feed roller 8*b*, a friction roller 8*c*, a sheet supplying plate 9, a stopper 10, an electrostatic capacitance type sensor 11, a synchronizing signal generator or sensor 12, a calculation and decision circuit 13, and a printing machine controller 14.

The compression cylinder 1, the blanket cylinder 3, the plate cylinder 4, the chain mechanism 7, the sheet pick-up unit 8*a* and the roller 8*b* of the sheet supplying device 8 and the stopper 10 are operated mechanically in association with one another. Whenever the compression cylinder 1 is turned as predetermined, the stopper 10 is displaced, so that a printing sheet is taken by the gripper 2 out of the sheet supplying plate 9 and is then subjected to the printing.

On the other hand, the top printing sheet 6 in the hopper 5 is picked up and inserted between the rollers 8*b* and 8*c* by the sheet pick-up unit 8*a*. That is, the printing sheets 6 in the hopper 5 are delivered out through the rollers 8*b* and 8*c* to the sheet supplying plate 9 one after another. In this operation, the hopper 5 is moved upwardly by the chain mechanism 7 so that the top one of the printing sheets 6 piled in the hopper 5 is raised to a position between the rollers 8*b* and 8*c*. Thus, the sheets 6 are successively taken out of the hopper 5, so as to be subjected to offset printing.

The detailed description of the operation of the offset press will be omitted, because it is well known in the art.

The aforementioned sensor 11 is provided at a position which is above the sheet supplying plate 9 and near the stopper 10, so that the number of sheets immediately below the sensor 11 is detected and a signal having a frequency corresponding to the number of sheets thus detected is outputted by the sensor. The synchronizing signal generator 12 is provided for the compression cylinder 1, so as to output a synchronizing signal whenever the cylinder 1 is turned as predetermined. The synchronizing signal is applied to the calculation and decision circuit 13.

The calculation and decision circuit 13 operates to receive the output signal of the sensor 11 with a predetermined timing, to detect the number of sheets, and to provide, only when the number of sheets is not acceptable, or abnormal, an output signal which is applied to the printing machine controller 14.

Figure 2:
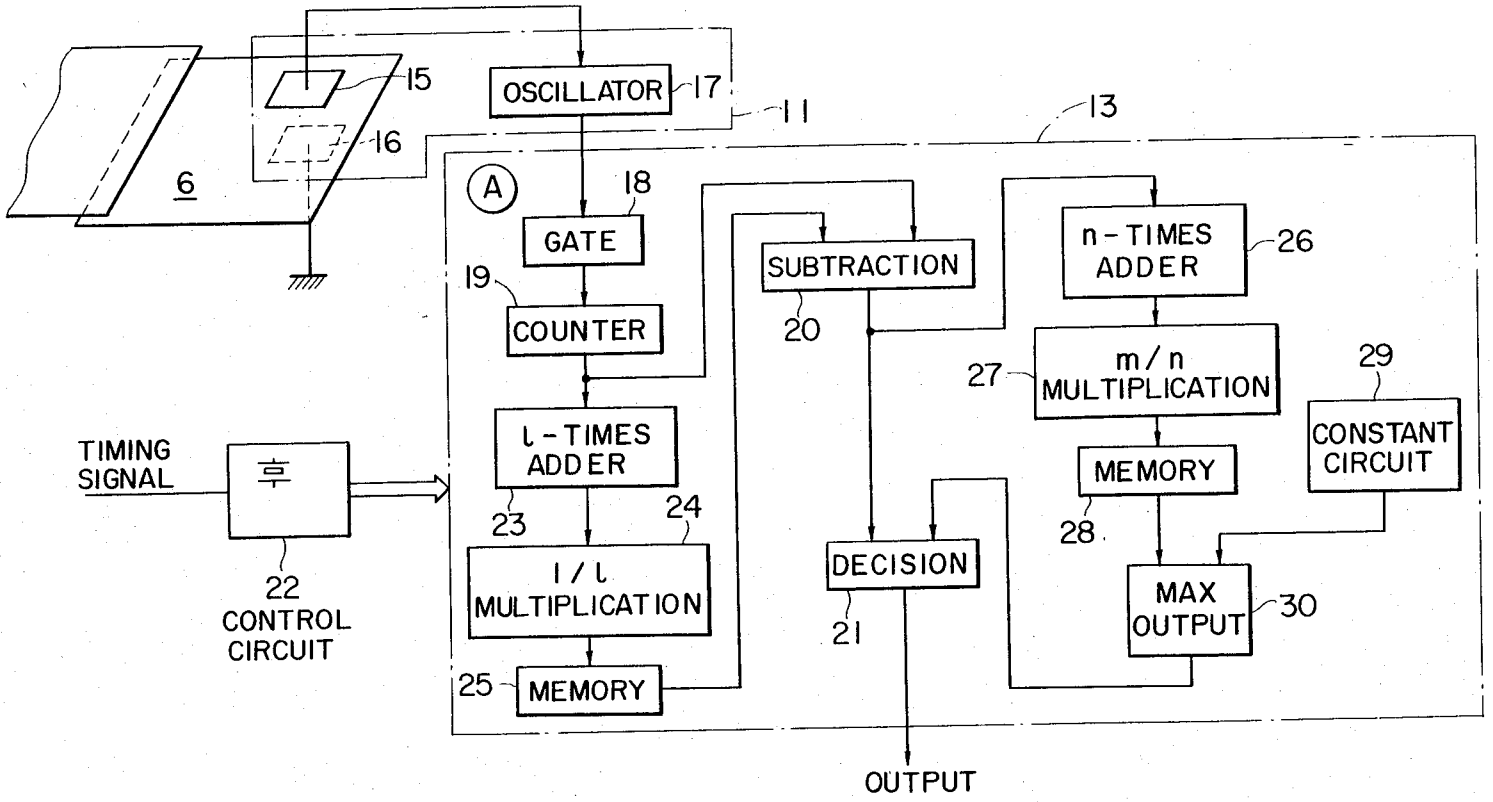
FIG. 2 is a block diagram showing one example of a plural-sheet detector according to this invention.

One example of the plural-sheet detecting device according to the invention, as shown in FIG. 2, comprises: detecting plates 15 and 16 forming an electrostatic capacitance therebetween; an oscillator circuit 17; a gate circuit 18; a counter circuit 19; a subtraction circuit 20; a decision circuit 21; a control circuit 22 for generating a timing signal for control; an l-times addition circuit 23; a 1/l multiplication circuit 24; a memory 25; an n-times addition circuit 26; an m/n multiplication circuit 27; a memory 28; a constant circuit; and a MAX output circuit 30.

The detecting plates 15 and 16 are provided on both sides of the sheet supplying plate 9 in such a manner that they are spaced from each other. Thus, the plates 15 and 16 form an electrostatic capacitance therebetween with a sheet moving on the sheet supplying plate 9 as a part of the dielectric. The oscillation frequency of the oscillator circuit 17 is determined by the capacitance. The plates 15 and 16 and the oscillator circuit 17 form the aforementioned electrostatic capacitance type sensor 11. In practice, the detecting plate 16 is the body of the printing machine, and therefore it is unnecessary to provide the plate 16.

The control circuit 22 operates to provide control signals in synchronization with a timing signal from the synchronizing signal generator 12 (FIG. 1), to operate the various circuits.

The operation of the circuitry shown in FIG. 2 will be described.

First, in synchronization with the operating of the printing machine, i.e. the phase of rotation of the compression cylinder 1, the control circuit 22 supplies a gate signal to the gate circuit 18 to open the latter 18 for a predetermined period of time, for instance 1 ms, so that the frequency signal of the oscillator circuit 17 is applied to the counter circuit 19, where it is counted.

The count value of the counter circuit 19 is applied to the l-times addition circuit 23. More specifically, the count value is added whenever the gate circuit 18 is opened to supply the count value to the addition circuit 23 from the counter circuit 19. When this addition is repeated l times, the addition result is multiplied by the factor 1/l by the 1/l multiplication circuit 24 and is then stored, as a reference count value, in the memory 25.

On the other hand, the count value of the counter circuit 19 is further applied to the subtraction circuit 20, and both the count value and the reference count value read out of the memory 25 is subjected to subtraction. The result of the subtraction is applied, as a deviation value, to the decision circuit 21.

The deviation value from the subtraction circuit 20 is applied to the n-times addition circuit 26, where it is subjected to addition until it is applied n times. The result of the addition is multiplied by the factor 1/n and then by the factor m by the m/n multiplication circuit 27. The result of the multiplication is stored in the memory 28. In the MAX output circuit 30, the data stored in the memory 28 is compared with a constant value provided by the constant circuit 29, and the larger of these data is outputted as a reference comparison value.

In the decision circuit 21, the deviation value provided by the subtraction circuit 20 is compared with the reference comparison value provided by the MAX output circuit 30. When the deviation value is smaller than the reference comparison value, the number of sheets is determined acceptable or normal; and when the former is larger than the latter, the number of sheets is determined not acceptable, or abnormal. Thus, the decision circuit 21 provides output signals representative of these decision results.

As is clear from the above description, in the invention, it is detected whether or not the number of sheets is acceptable, by digitally processing the output signal of the sensor 11. Therefore, the detection is scarcely affected by noise signals, i.e. the detection is carried out with high accuracy.

In general, in order to determine whether or not a detected measurement value is in a predetermined range, a method is employed in which the measurement value is compared with a predetermined reference value, and it is decided whether or not the difference between the two values is in a certain range. For instance in the case of FIG. 2, the reference count value applied to the subtraction circuit 20 is predetermined, while the reference deviation value applied to the decision circuit 21 is the constant value provided by the constant circuit 29. Thus, these values can be sufficiently employed in the above-described method.

However, the frequency of the output signal of the sensor 11 is varied not only by the number of sheets between the detecting plates 15 and 16 but also by the variation in dielectric constant of the sheet due to the variation of the ambient temperature or the humidity. In addition, the frequency is affected by the drift of an electrical circuit such as for instance the oscillator circuit 17.

Therefore, when the reference count value applied to the subtraction circuit 20 has become the predetermined value, the above-described frequency variation is detected as the unacceptable number of sheets. Thus, the provision of the plural-sheet detecting device is meaningless. In order to eliminate this difficulty, it is necessary to monitor the device at all times, so as to cause the reference count value to follow the variation of frequency due to the above-described causes.

In the above-described embodiment of the invention, the output count value of the counter circuit 19 is added l times, i.e. l output count values are added, and the result of the addition is multiplied by the factor 1/l. The result of the multiplication is stored and is used as the reference count value for l times. In other words, in the embodiment, the average value of l count values provided by the counter circuit 19 is employed as the reference count value. Thus, in the embodiment of the invention, the detected count value and the reference count value subjected to subtraction follow the variation of frequency due to the temperature, humidity and drift described above thereby to be automatically varied. Therefore, the deviation value obtained through subtraction represents substantially only the unacceptability in the number of sheets. Thus, the device operates with high accuracy, and is substantially free from erroneous operation at all times. Furthermore, the measurement is carried out l times before the device is started, and therefore the initial operation of the device can be smoothly shifted into the detection operation substantially without adjustment.

Since the raw material of the sheet is a substantially natural one, it is relatively non-homogenous in composition. Therefore, even if the same kind of sheets are used, they are considerably variable in dielectric constant. Accordingly, in the case where the constant value provided by the constant circuit 29 is used as the reference comparison value applied to the decision circuit 21, even if the number of sheets is acceptable or normal, it may be determined as unacceptable because of the variation of the dielectric constant described above.

However, in the embodiment, n deviation values provided by the subtraction circuit are added and the result of the addition is multiplied by the factor 1/n; that is, the average value is obtained. Then, the average value is multiplied by the factor m, so as to obtain a value with a tolerance. The value thus obtained is stored in the memory 28, and it is selectively read out of the memory by the MAX output circuit 30, so as to be supplied as the reference comparison value to the decision circuit 21.

In the case where, although the same kind of sheets are printed, they are considerably variable in dielectric constant because they are different in manufacturing lot, in the embodiment of the invention the reference deviation value becomes large automatically following the variation, and therefore the above-described erroneous detection due to the variation can be positively avoided. Thus, the operation of the device is always correct, detecting only the abnormality in the number of sheets.

If the kind of sheets is changed, of course the degree of variation in dielectric constant is changed. However, the detection operation of the device automatically follows the variation. Therefore, even if the kind of sheets is changed, the device needs no adjustment.

Figure 3:
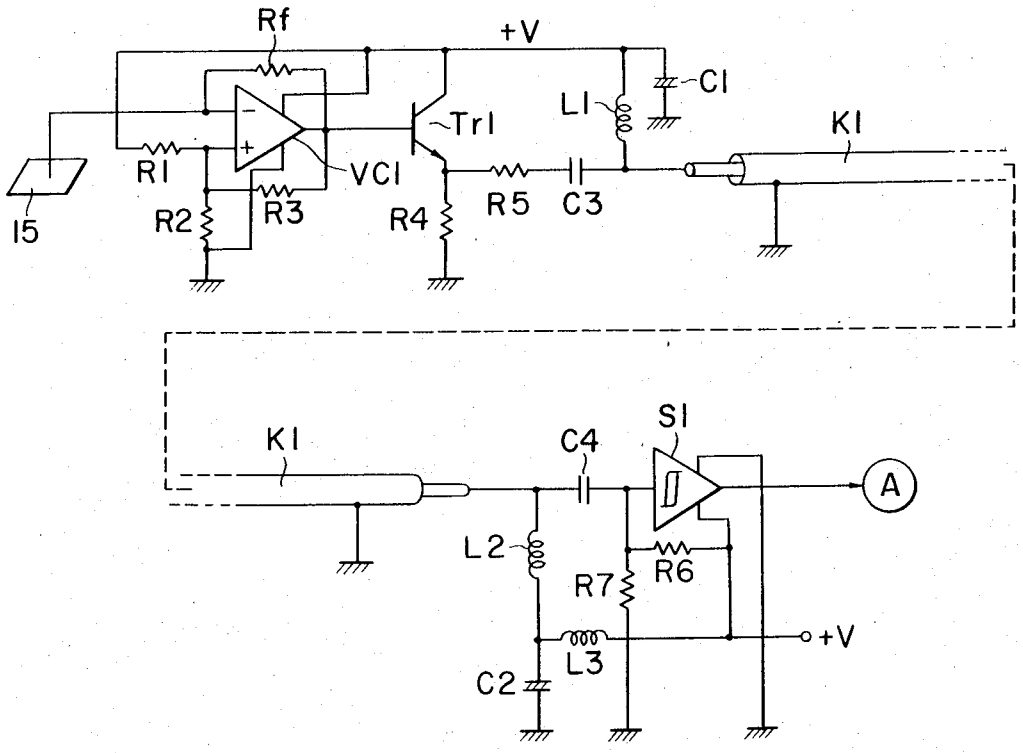
FIG. 3 is a circuit diagram showing one example of an electrostatic capacitance type sensor employed in the detector in FIG. 2.

One example of the electrostatic capacitance type sensor is as shown in FIG. 3.

In FIG. 3, reference character VC1 designates a comparator such as an operational amplifier, to the negative input terminal of which the detecting plate 15 is connected. The voltage of a power source +V is subjected to voltage division by resistors R1 and R2 and is then applied to the positive input terminal of the comparator VC1. The comparator VC1 is provided with feedback resistors Rf and R3, so that it serves as a multivibrator type oscillator. The oscillation frequency is determined by the capacitance of the detecting plate 15 and the resistance of the feedback resistor Rf. Therefore, the comparator VC1 outputs a signal having a frequency corresponding to the number of sheets below the detecting plate 15.

A transistor Tr1 is emitter-follower type one, having an emitter load resistor R4. The transistor Tr1 forms a drive circuit for applying the output of the comparator VC1 to a coaxial cable K1 through an impedance matching resistor R5 and a capacitor C3 for blocking a d.c. component.

A Schmitt trigger circuit S1 operates to shape a signal applied thereto through a coupling capacitor C4 into a pulse having a predetermined waveform, thereby facilitate the counting operation. Resistors R6 and R7 are provided to apply a bias voltage to the input of the Schmitt trigger circuit S1.

Inductors L1, L2 and L3 and capacitors C1 and C2 form a low-pass filter. The voltage of the power source +V is applied through the low-pass filter and the signal transmitting cable K1 to the comparator.

In the example of the sensor shown in FIG. 3, the oscillator having the comparator VC1 and the transistor Tr1, the drive circuit and the detecting plate 15 can be formed into a small probe which can be connected to the calculation and decision circuit 13 only through the one coaxial cable. Therefore, the sensor 11 can be readily set at the most suitable position, which makes it allow accurate detection operation and avoids the detection of noises from the power source circuit, etc. Thus, the device can operate positively.

Figure 4:
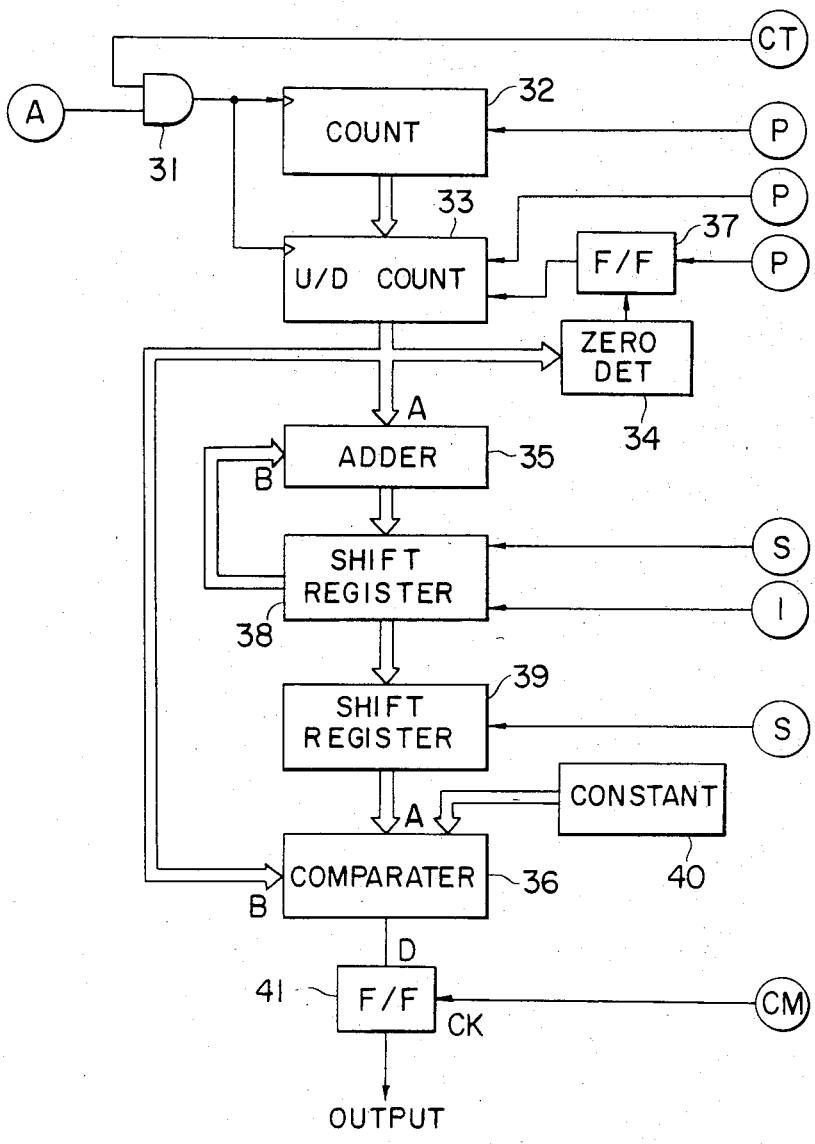
FIG. 4 is a block diagram showing another example of the plural-sheet detector of the invention, which is formed with TTL digital IC's.

One embodiment of the invention in which the calculation and decision circuit 13 including the gate circuit 18 through the MAX output circuit 30 is formed by digital integral circuits such as TTL's (transistor-transistor logics) is as shown in FIG. 4.

In FIG. 4, reference numeral 31 designates an AND gate; 32, a counter; 33, an up-down counter; 34, a zero detector; 35, an adder; 36, a comparator; 37, a flip-flop circuit; 38 and 39, shift registers; 40, a constant circuit; and 41, a flip-flop circuit.

Figure 5:
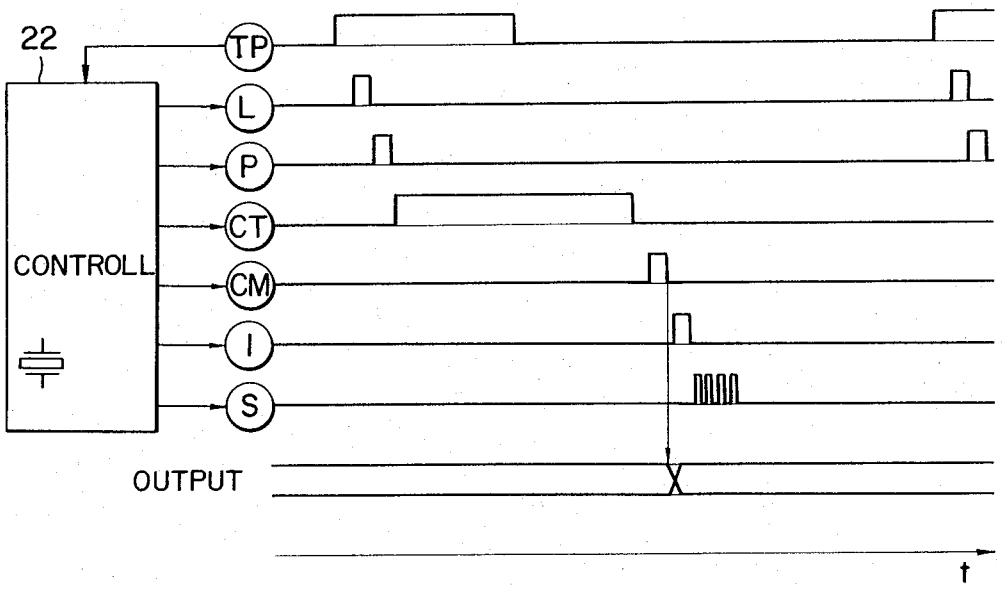
FIG. 5 is a time chart showing control signals employed in the detector in FIG. 4, for a description of the operation thereof.

FIG. 5 shows the timing signal supplied to the control circuit 22 from the synchronizing signal generator 12, and various control signals L, P, CT, CM, I and S which are provided by the control circuit 22 in response to the timing signal. The operation of the circuit shown in FIG. 4 will be described with reference to FIG. 5. However, the operation of the control circuit will not be described, because the formation of the above-described control signals with TTL's and IC's is well known in the art.

The frequency signal (A) from the sensor 11 is applied to one input terminal of the AND gate 31, and it is outputted by the AND gate 31 in response to the control signal CT applied to the other input terminal of the AND gate 31. The output of the AND gate 31 is connected to the clock terminals of the counter 32 and the up-down counter 33. The output of the counter 32 is connected to the preset input of the up-down counter 33. The reset terminal of the counter 32 receives the control signal P, and the output of the up-down counter 33 is connected to the input terminals of the adder 35, the comparator 36 and the zero detector 34. The output of the zero detector 34 is connected to the trigger terminal of the flip-flop circuit 37, to the clear terminal of which the control signal P is applied. The output terminal of the flip-flop circuit 37 is connected to the U/D terminal (or the up-count and down-count selecting terminal) of the up-down counter 33. The control signal L is applied to the load terminal (or the preset and count selecting terminal) of the up-down counter 33.

The operations of the circuit elements described so far will be described. When the timing signal TP synchronous with the operation of the printing machine is applied to the control circuit 22 (FIG. 5), the latter 22 outputs the control signal L. As a result, the count value of the counter 32 at the preceding detection is preset in the up-down counter 33. When the control circuit 22 outputs the control signal P, the counter 32 is cleared to zero. At the same time the flip-flop circuit 37 is also cleared, and the up-down counter 33 is placed in a down count mode.

Next, the control circuit 22 outputs the control signal CT. While the control signal CT is at a high logic level (herein-after referred to as "H", when applicable), the AND gate 31 outputs the signal (A) in the form of a pulse. As a result, the counter 32 and the up-down counter 33 start the counting operations. When the signal CT is set to a low logic level (hereinafter referred to as "L" when applicable), the counter 32 holds the count value until the provision of the next signal P. That is, it serves as the counter circuit 19, the l times addition circuit, the 1/l multiplication circuit 24 and the memory 25 in FIG. 2(where $l=1$).

Being in the down count mode, the up-down counter 33 down-counts (or decreases) the preset value, and outputs the difference between the preceding count value and the present count value when the signal CT is set to "L". In the case where the preceding count value is smaller than the present count value, the output of the up-down counter 33 becomes zero during counting. This is detected by the zero detector 34, so that the flip-flop circuit 37 is triggered. Thus, the up-down counter 33 is placed in an up counter mode by the output of the flip-flop circuit 37. As a result, the up-down counter 33 up-counts (or increases) the count value until the signal CT is set to "L". That is, irrespective of the magnitudes of the preceding count value and the present count, the absolute value of the difference therebetween is outputted.

Thus, the parts described above have the functions of the counter circuit 19 and the subtraction circuit 20 in FIG. 2.

Referring back to FIG. 4, the output of the up-down counter 33 is connected to the input A of the adder 35, the output of which is connected to the parallel input terminal of the shift register 38. The parallel output terminal of the shift register 38 is connected to the input B of the adder 35. The serial output terminal of the shift register 38 is connected to the serial input terminal of the shift register 39, the parallel output terminal of which is connected to some terminals of the input A of the comparator 36. The remaining terminals of the input A of the comparator 36 are connected to the output of the constant circuit 40. The input B of the comparator 36 is connected to the output of the up-down counter 33. The terminal of the comparator 36 through which $A<B$ is outputted is connected to the input terminal D of the D flip-flop circuit 41. The control signal CM is applied to the terminal CK (trigger input terminal) of the flip-flop circuit 41. The control signals S and I are applied to the shift register 38. The control signal S is applied to the shift register 39.

The operations of the above-described circuit elements will be described.

In the comparator 36, the output of the up-down counter 33 (i.e. the absolute value of the difference between the preceding count value and the present count value) namely, the input B is compared with the input A. When $A<B$, the comparator 36 applies a signal at "H" to the input terminal D of the D flip-flop circuit 41. When not $A<B$, the comparator 36 outputs a signal at "L". When the control circuit 22 in FIG. 5 outputs the control signal CM, the flip-flop circuit 41 outputs the signal applied to the input terminal D at that time. This state is maintained until the next control signal CM is applied. If the output of the flip-flop circuit 41 is at "H", it means the unacceptable number of sheets (or double sheets); and if it is at "L", it means the acceptable number of sheets. Thus, if the output signal of the flip-flop circuit 41 is coupled to the prime mover of the printing machine or the sheet supplying stop mechanism, then the double-sheet can be prevented.

The signal at the input A of the comparator 36 (or the decision level) is controlled by the control signals I and S from the control circuit 22 in FIG. 5. That is, as the absolute value of the difference between the preceding count value and the present count value is applied to the input A of the adder 35 while the parallel output of the shift register 38 is applied to the input B of the adder 35, the sum of both inputs is outputted by the adder 35 and is applied to the parallel input terminal of the shift register 38. When, under this condition, the control signal I is applied to the parallel input control terminal of the shift register 38, the latter 38 reads the data at the parallel input terminal and stores it. In this case, the parallel output terminal of the shift register 38 outputs the output value of the adder 35 (i.e. the sum of the inputs A and B of the adder 35) which is obtained before the control signal I is applied to the shift register 38. In other words, the present count value is added to the value which has been stored before the application of the control signal I, and the result of the addition is stored in the shift register 38, so as to be ready for the next addition (or for addition n times). Whenever a counter in the control circuit 22 counts n addition operations, the control circuit 22 outputs one control signal S. The control signal S is applied to the clock terminals of the shift registers 38 and 39 to shift the data therein. If it is assumed that K clock pulses are required to shift all the data from the shift register 38 to shift register 39, then the control signal S provides (K−log 2m) pulses (where m is $2^a$, and a=1, 2, 3, . . . ). This operation corresponds to the operations of the n times addition circuit 26 and the m/n multiplication circuit 27 in FIG. 2. The serial input terminal of the shift register 38 is set to "L" at all times, and the shift register 38 is cleared by the control signal S, so that zero is stored in the shift register 38.

The value which is obtained by multiplying by the factor m/n the result of n times addition of the deviation value of the count value, is outputted through the parallel output terminal of the shift register 39. The value thus outputted is applied to the higher bits of the input A of the comparator 36, while the output value of the constant circuit 40 is set at the lower bits.

Thus, even in the case where the deviation value of the count value is zero for n times, the minimum decision level can be maintained, thus preventing the erroneous operation. In addition, in the case where the sheets are considerably variable in electrostatic capacitance (as in the raw sheets), the decision level is automatically increased, to prevent the erroneous operation.

Figure 6:
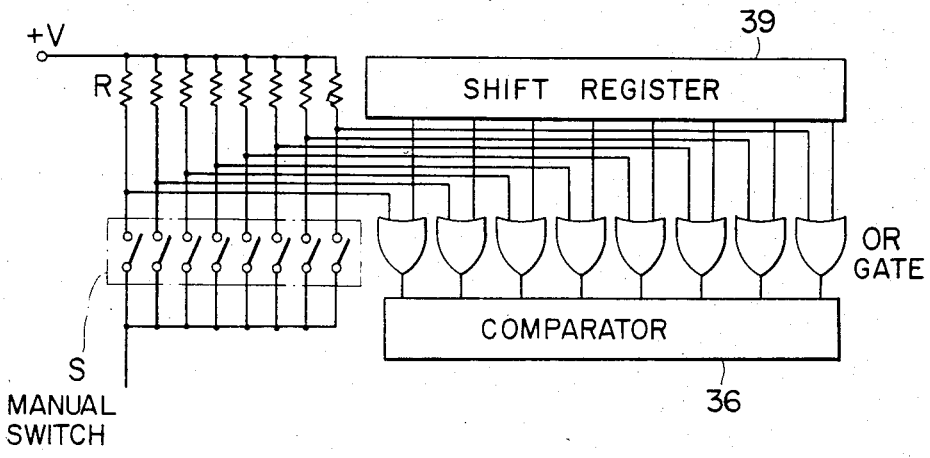
FIG. 6 is a circuit diagram showing one example of a constant circuit in FIG. 4.

Sometimes it is convenient that the set value of the constant circuit 40 is manually variable. One example of a circuit for practicing this idea is as shown in FIG. 6. However, the description of the operation of the circuit will be omitted, since the operation can be readily understood by those skilled in the art.

One example described above of the present invention is constituted by integrated circuits of TTL's (transistor-transistor logics); however, the device may be constituted by using a computer (such as a microcomputer).

In general, as the oscillation frequency of the electrostatic capacitance type sensor 11 (FIG. 1 and FIG. 2) is increased, the detection accuracy is increased. The reason for this is as follows: Since the detection time is limited by the speed of the printing machine, it is impossible to increase the detection time beyond a certain value. It is assumed that the detection period is 1 m sec for instance. If, in this case, the oscillation frequency is 1 MHz, then the count value is 1000, and since the reading of one count is the minimum value, the accuracy is 1/1000. If the oscillation frequency is increased to 10 MHz, then the accuracy is 1/10000; i.e. it is increased by one place.

In the case where the device is constituted by digital IC's of TTL's as shown in FIG. 4, a practically sufficient accuracy can be obtained by increasing the oscillation frequency because a TTL can operate at about 100 MHz in maximum. However, it is impossible to operate an ordinary microcomputer at such a high speed, and accordingly it is difficult to obtain a sufficiently high accuracy.

Figure 7:
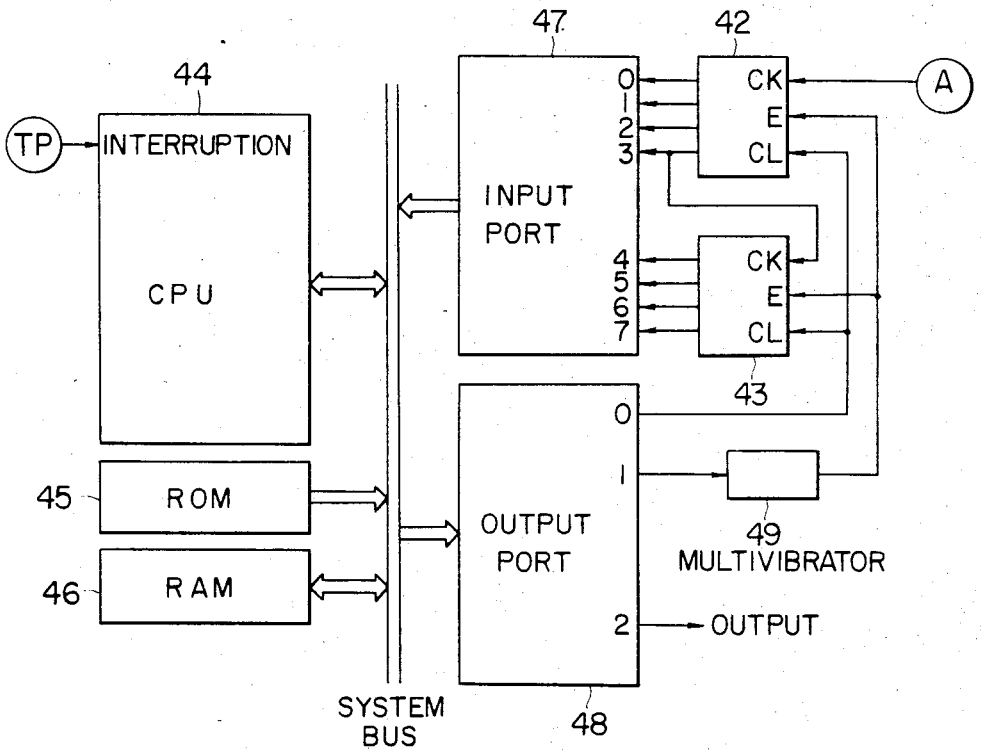
FIG. 7 is a block diagram showing another example of the detector of the invention, which uses a microcomputer.

Shown in FIG. 7 is another embodiment of the invention in which a sufficiently high accuracy can be obtained with a microcomputer.

In FIG. 7, reference numerals 42 and 43 designate counters made up of TTL type high speed IC's; 44, a CPU (central processing unit) of a microcomputer; 45, a ROM (read-only memory); 46, a RAM (random access memory); 47, the input port of the microcomputer; 48, the output port of the microcomputer; and 49, a monostable multivibrator.

The signal (A) is applied to the clock input terminal of the counter 42. The outputs of the counters 42 and 43 are connected to the input port 47. The output of the input port 47 is connected to a system bus, which is connected to the CPU 44, the ROM 45, the RAM 46 and the output port 48. The timing signal TP from the printing machine is applied to the interruption input of the CPU 44. The output port 48 provides an output signal representative of a decision result, a signal for clearing the counters 42 and 43, and a signal for operating the monostable multivibrator 49 for enabling the counters.

The operation of the circuit shown in FIG. 7 will be described.

When the CPU 44 receives the timing signal TP from the printing machine, the clear signal is outputted at the terminal O of the output port 48, to clear the counters 42 and 43. Then, the signal is provided at the terminal 1 of the output port 48, to set the output of the multivibrator 49 to "L", thereby to enable the counters 42 and 43.

Thus, the counters 42 and 43 start counting the signal (A), and this counting operation is continued until the output of the multivibrator 49 is raised to "H". In this operation, in the CPU 44 the data at the terminal 7 (the most significant bit output terminal of the counter) of the input port 47 is repeatedly loaded into the accumulator, and whenever the level of the data is changed from "H" to "L", increment is carried out in the register (or one (1) is added in the register). When the output of the multivibrator 49 is raised to "H", the counting is ended. At this time instant, the lower bits of the count value are stored in the external counters 42 and 43, while the higher bits are stored in the register in the CPU 44. Next, in the CPU 44, the lower bits are loaded in the register therein through the input port 47 and the processing is carried out to provide a decision result, which is outputted at the output terminal 2 of the output port 48.

As the circuit is arranged as described above, the microcomputer can follow the high speed operation, and the device operates with high accuracy. As the register of the CPU 44 is employed as a part of the counter, the number of components forming the external counters can be reduced as much. Thus, the device can be manufactured small in size at low cost.

Furthermore, since the processing is carried out according to the program in the ROM 45, a different processing can be selectively employed by changing the program. Accordingly, the device of the invention has a wide range of application, being used not only as a doublesheet detector but also as means for measuring the thickness of various materials and the distance from various objects.

The effects of the invention can be summarized as follows:

(1) In the invention, the detection data is processed as the count value in the form of a digital signal. Even if the count value differs only by one count, the difference can be clearly detected. Thus, the operation is reliable and high in accuracy.

(2) In the invention, the abnormality is not determined merely by comparing the detected count value with the reference count value; that is, the determination is made by comparing the deviation value, which is obtained through the comparison, with the reference comparison value. Therefore, the decision result is not affected by the variations of the count value due to the drift of the sensor, the variations in characteristic of sheets, etc. Thus, the decision result is considerably high in reliability.

(3) In the invention, the reference count value and the reference comparison value are not fixed ones, and instead values which are obtained automatically through calculation from at least one detection data. Thus, these values can follow the variations in condition of an object such as a sheet to be detected as well as the variations in operating condition of the sensor. Therefore, the device of the invention is substantially free from erroneous operation and needs no adjustment in operation.

In the above-described embodiments of the invention, the device is so designed that the electrostatic capacitance type sensor 11 detects the number of objects such as sheets. However, the invention is not limited thereto or thereby. That is, if an analog-to-digital converter is employed to convert the detection result into digital data, then the object of the invention can be satisfactorily achieved with other type sensors such as for instance an optical sensor. If, in this connection, a V/F (voltagefrequency) converter is used, then the above-described embodiments can be applied, as they are.

Thus, according to the invention, the detection can be carried out with an electrical sensor or an optical sensor with high accuracy.

What is claimed is:

1. A plural-sheet detector for detecting a number of the sheet-shaped materials piled one on another as a number of serial pulse signals, which comprises:

means for providing, whenever said serial pulse signals are detected, a count value thereof; means averaging said count values a predetermined number of times for producing a reference count value, means for providing a deviation value representative of the difference between said count value and a reference count value; and decision means for comparing said deviation value with a reference comparison value, so that when said deviation value exceeds said reference comparison value, the number of sheet-shaped materials piled one on another is determined to be unacceptable.

2. A detector as claimed in claim 1, in which said reference comparison value is a larger one of a predetermined value and a value larger than a value calculated from an average value of said deviation values which are detected a predetermined number of times.

* * * * *